US008550428B2

(12) United States Patent
Echenausía Saez de Zaitegui et al.

(10) Patent No.: US 8,550,428 B2
(45) Date of Patent: Oct. 8, 2013

(54) ROTARY GAS TAP WITH AN INTEGRAL ELECTROMAGNETIC VALVE

(75) Inventors: Francisco Javier Echenausía Saez de Zaitegui, Aretxabaleta (ES); Félix Querejeta Andueza, Vitoria-Gasteiz (ES); José Ignacio Múgica Odriozola, Bergara (ES)

(73) Assignee: Mondragon Componentes, S. Coop, Aretxabaleta Gipuzkoa (ES)

( * ) Notice: Subject to any disclaimer, the term of this patent is extended or adjusted under 35 U.S.C. 154(b) by 708 days.

(21) Appl. No.: 12/301,007

(22) PCT Filed: Apr. 27, 2007

(86) PCT No.: PCT/ES2007/070085

§ 371 (c)(1),
(2), (4) Date: Aug. 12, 2009

(87) PCT Pub. No.: WO2007/132050

PCT Pub. Date: Nov. 22, 2007

(65) Prior Publication Data

US 2010/0219361 A1 Sep. 2, 2010

(30) Foreign Application Priority Data

May 16, 2006 (ES) ..... 20060113

(51) Int. Cl.
*F16K 31/02* (2006.01)

(52) U.S. Cl.
USPC ..... 251/129.15; 137/66

(58) Field of Classification Search
USPC ..... 251/129.15, 129.21; 137/66
See application file for complete search history.

(56) References Cited

U.S. PATENT DOCUMENTS 302,519 A * 7/1884 Wright et al. ..... 278/65
2,658,514 A * 11/1953 Meusy ..... 137/66

(Continued)

FOREIGN PATENT DOCUMENTS

EP 0159393 A1 10/1985
EP 1045206 A2 10/2000

(Continued)

OTHER PUBLICATIONS

PCT International Preliminary Report on Patentability, Jan. 20, 2009, The International Bureau of WIPO.

(Continued)

*Primary Examiner* — Eric Keasel
*Assistant Examiner* — David Colon Morales
(74) *Attorney, Agent, or Firm* — Tim L. Kitchen; Peter B. Scull; Hamilton, DeSanctis & Cha, LLP

(57) ABSTRACT

The rotary gas tap (1) with an electromagnetic safety valve (3), is of the conical regulation member (7) type, and the electromagnetic actuator (3*a*), being of a smaller power and size, is built entirely into a pipe housing (2*a*) in the body of the tap. The valve actuator (3*a*) is of the type where the seal member (9) is lifted by means of a DC voltage. The cylindrical magnetic frame (14) penetrating into the coil (15) is guided inside it, and a magnetic capsule (16) surrounding the coil is of a diameter Dh of around 14 mm, adjusted to that of the housing (8) in the body of the tap (2*a*). The stroke "R" of the seal member (9) corresponds to a gap (G) greater than 2.5 mm, reaching a sizeable passage opening "A" in the valve (9,10) necessary for a maximum inlet flow (Q) in the tap. At the same time the electromagnetic actuator (3*a*) is of low power, by means of a low reluctance in the magnetic circuit (13-16), although the diameter "Da" of the cylindrical frame is restricted to less than 4 mm.

17 Claims, 1 Drawing Sheet

(56) References Cited

U.S. PATENT DOCUMENTS

| | | | | |
|---|---|---|---|---|
| 2,685,803 | A * | 8/1954 | Weber et al. | 74/503 |
| 2,735,439 | A * | 2/1956 | Coffey | 137/66 |
| 2,832,364 | A * | 4/1958 | Matthews | 137/66 |
| 3,180,357 | A | 4/1965 | Galley | |
| 3,368,789 | A * | 2/1968 | Helmut | 251/129.15 |
| 4,242,080 | A * | 12/1980 | Tabei | 431/54 |
| 4,540,154 | A * | 9/1985 | Kolchinsky et al. | 251/129.15 |
| 4,679,767 | A * | 7/1987 | Vollmer et al. | 251/129.15 |
| 4,738,430 | A * | 4/1988 | Pichon | 251/129.15 |
| 5,181,846 | A * | 1/1993 | Chang | 431/80 |
| 5,199,456 | A * | 4/1993 | Love et al. | 137/270 |
| 5,358,215 | A * | 10/1994 | Buth et al. | 251/129.21 |
| 5,544,857 | A * | 8/1996 | Torrence | 251/129.15 |
| 5,605,318 | A * | 2/1997 | Malone et al. | 251/129.15 |
| 6,192,913 | B1 * | 2/2001 | Willey et al. | 137/66 |
| 6,352,428 | B1 * | 3/2002 | Uribetxebarria et al. | 431/80 |
| 6,725,877 | B2 * | 4/2004 | Liorati et al. | 137/486 |
| 6,769,447 | B2 * | 8/2004 | James | 137/66 |
| 6,840,504 | B2 * | 1/2005 | Hagiwara et al. | 251/332 |
| 6,848,474 | B2 * | 2/2005 | Sollier | 137/613 |
| 6,886,581 | B2 * | 5/2005 | Harniet | 137/66 |
| 6,971,629 | B2 * | 12/2005 | Okada et al. | 251/129.15 |
| 6,994,308 | B1 * | 2/2006 | Wang et al. | 251/30.04 |
| 2006/0138372 | A1 * | 6/2006 | Haedicke et al. | 251/129.15 |
| 2006/0214126 | A1 * | 9/2006 | Kimble | 251/129.21 |

FOREIGN PATENT DOCUMENTS

| | | | |
|---|---|---|---|
| ES | 2161601 | A1 | 12/2001 |
| GB | 2122003 | A | 1/1984 |
| JP | 61159028 | A | 7/1986 |
| JP | 2000337637 | A | 12/2000 |
| WO | WO2004031632 | A1 | 4/2004 |

OTHER PUBLICATIONS

International Search Report for International Application No. PCT/ES2007/070085, Aug. 6, 2007.

* cited by examiner

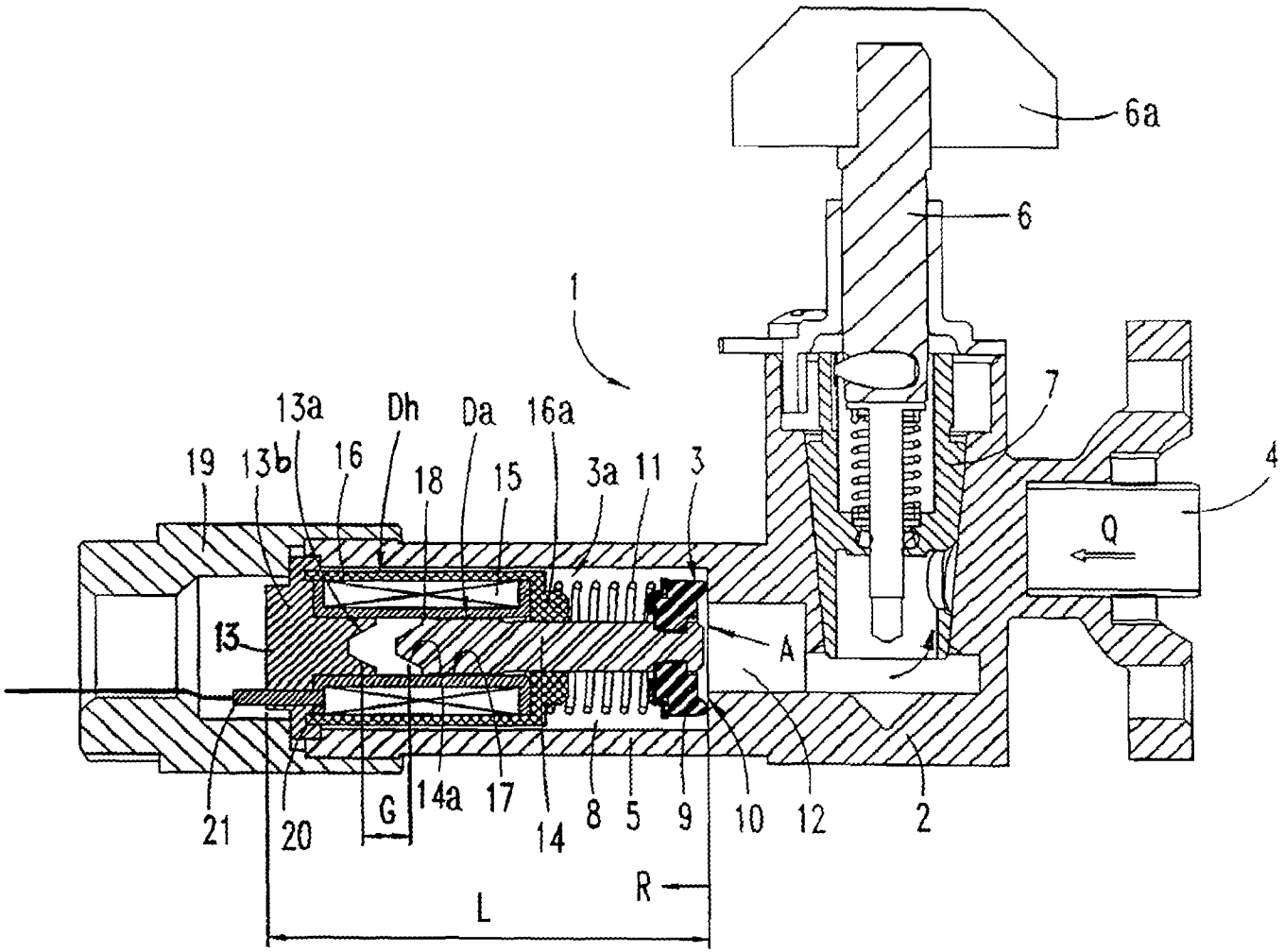
6a
6
7
4
Q
2
12
A
10
3
9
11
5
R
3a
8
1
16a
14
15
17
L
Da
14a
18
Dh
G
16
13a
20
13b
13
19
21

ROTARY GAS TAP WITH AN INTEGRAL ELECTROMAGNETIC VALVE

The present invention relates to a rotary-type gas tap for the regulation of a flow in a domestic appliance, with an electromagnetic safety valve built into a gas-flow pipe inside the tap, operated and kept open by an external DC voltage.

PRIOR ART

There known rotary gas taps of the type mentioned above that are adapted to a domestic cooking appliance or stove wherein an electromagnetic safety valve is built into a gas-flow pipe regulated by means of a conical regulation member. The valve actuator coil is operated initially by a manual ram or a DC voltage in order to attract the magnetic frame and open the valve, and is then kept open by a low-intensity electrical current, conditioned to a flame presence sensor.

EP-A-1045206 (ES-2161601-A) discloses a rotary gas tap that regulates a flow by means of a conical regulation member, wherein an electromagnetic actuator of a safety valve is built into an additional tubular housing secured by a threaded joint on the free end and provided with an electrical connector for a Vdc operating voltage.

WO-2004/031632-A discloses a rotary gas tap adapted to a domestic cooker, with an electromagnetic safety valve operated by a DC voltage from an external source and comprising an electromagnet with a moving cylindrical frame projecting into the coil, which solves the problem of an electromagnet actuator with sufficient attraction force to attract a frame with a sizeable gap to lift the seal member sufficiently. This valve actuator has a large coil that is coupled to the body of the tap on the outside of the valve housing, and may be dismantled to enable it to be replaced. As well as requiring a high electrical power, an electromagnetic actuator as large as this generates significant impacts on the magnetic frame, and as it is made up of two separable parts, additional guide means are required for the moving frame and airtight means for the fixed core.

DISCLOSURE OF THE INVENTION

It is the object of the invention to provide a rotary gas tap adapted to a domestic cooking or heating appliance, with an electromagnetic safety valve built into the body of the tap, wherein the electromagnetic actuator is of the small, compact type and driven by a low external Vdc voltage, and has a moving, cylindrical magnetic frame guided axially inside the coil, which effects with the seal member a lifting stroke "R" that is sufficiently long for the valve opening width necessary to allow the passage of a maximum inlet flow in the tap without charge loss.

The electromagnetic safety valve built into a pipe of the rotary gas tap has a low-power electromagnet due to the reduced size of the valve actuator, which must be adjusted to the diameter of the tubular housing pipe. The entire electromagnetic actuator is built into the body of the tap using a small, low-power coil, and means for coupling the actuator in the pipe of the body that are of a simple construction and cheap, the closure member and the moving frame being capable of attracting a long gap of 2.5 mm or more despite their small size and the low supply current, also generating an attraction force that exceeds a nominal force, for the purposes of facilitating the operation when, over the passage of time, the reluctance of the electromagnet is reduced due to the wear of the magnetic contact surfaces of the moving frame and the counter-frame in the core.

The electromagnet actuator is of low power and, at the initial moment of operation, generates an attraction force in the moving frame that is also sufficient for lifting, from the valve seating, a rubber seal, overcoming the resistance of the "sticking" in addition to the force of the return spring. Although the electromagnet of the safety valve has to be small in size so that it may be built into the body of the tap, it is built with a long gap that enables sizeable lifting of the seal member, thereby ensuring a sufficient area of valve opening for the passage of all the gas flow accessing the tap inlet. The high reluctance of the magnetic circuit caused by the long air gap between the moving frame and the core is compensated for by good magnetic closures at both ends of the steel casing of the electromagnet, and with minimum play in the movement between the frame and the coil.

DESCRIPTION OF THE DRAWINGS

FIG. 1 is a cross-sectional view of a rotary gas tap with a built-in electromagnetic safety valve.

DETAILED DISCLOSURE OF THE INVENTION

With reference to FIG. 1, a preferred embodiment of the rotary gas tap 1 with an electromagnetic safety valve 3 built into the compact body 2 of the tap comprises a rotary tap axis 6 with a control button 6*a* that manually regulates a main gas flow "Q" adapted to a domestic gas appliance, such as a cooker or a heating stove, between an inlet pipe 4 and an outlet pipe 5 in the tap body. The regulation member 7 is of the conical type and the safety valve 3 built into the tap body 2 comprises an electromagnetic actuator 3*a* with a seal member 9 of a material that is flexible against the force of a return spring 11. In an embodiment such as the one shown in FIG. 1, the housing 8 for the electromagnetic actuator 3*a* is built into a gas pipe 2*a* connected to the inlet pipe 4 in the tap, its diameter being adjusted to the small diameter "Dh" of the actuator 3*a*, around 12 mm. At the bottom of the pipe-housing 8 is built a seating 10 of the safety valve and a valve hole 12 that provides a opening section "A" for the passage of the maximum flow "Q" without charge loss.

The electromagnetic actuator 3*a* of the safety valve comprises an electromagnet 13,14,15 with a coil 15 for lifting the seal member 9, and is coupled in its entirety inside the housing 8, tightened against the pipe of the body 2*a* by means of a connector 19 threaded on its free end. On the other end of the pipe 2*a*, the seal 9 of the valve is pressed against the valve seating 10 pushed by the return spring 11. The moving magnetic frame 14 that carries the seal 9 is cylindrical in shape and has a diameter of around 4 mm, it being guided inside the tubular reel of the operating coil 15.

The ferromagnetic core 13 of the electromagnet comprises an external base 13*b* in the form of a disc, on which the coil 15 is supported, and electrically connects the "mass" of the tap, and an internal cylindrical segment 13*a* that penetrates into the coil 15, operating as a fixed counter-frame 13*a*. Between the counter-frame 13*a* and the moving frame 14 of the electromagnet is formed a long air gap "G" of between 2.5 and 5 mm, preferably 3 mm. The contact surfaces 14*a* of the moving frame and the counter-frame 13*a* have a substantially conical configuration, one of them complementary to the other to enable a male/female fitting between them, so that the area of contact between them is increased. The reluctance of the magnetic circuit is thus reduced in relation to the flat, cylindrical, cross-sectional contact frame that forms part of the prior art referred to in the introduction.

The coil 15 is enclosed in a magnetic steel capsule 16 which acts as a collector of the magnetic flow, completing the magnetic circuit of attraction between the moving frame 14 and the core 13. The magnetic capsule 16 is inserted tightly on a base of the core 13, forming a magnetic closure 20 against it. Said base 13*b* also includes a ring-shaped sector external to the capsule 16, offering a peripheral surface for the airtight closure of the electromagnet 13-16 in its pipe housing in the body 2*a*, the entire electromagnetic actuator 3*a* thus being coupled inside the tap 1.

The operating coil 15 is of low power, around 40 mW, and the cylindrical capsule 16 that surrounds the coil is of a small diameter "Dh", around 12 mm or smaller than 14 mm, and the coupling means 13-21 of the electromagnetic actuator 3*a* are of a simple construction and cheap. The electrical power of the coil 15 and the number of thread turns, around 1,700 turns and 100 ohms, are adapted to said diameter "Dh" of the surrounding steel capsule 16, and to a total actuator length "L" of approximately 33 mm. The force necessary to keep the frame 14 attracted and the safety valve 3 open is generated in the coil with the magnetic field of around 34 Amps per turn. An electrical connector 21 for the coil 15 passes through the base of the core 13*b*, insulated electrically from it and projecting outwards, for the supply of an external Vdc operating voltage of around 65/80 Vdc.

The opposite end of the steel capsule 16 close to the seal member 9 is closed against a collar 16*a* for guiding the moving frame 14, which is adjusted to the diameter "Da" of the frame 14, around 4 mm, the purpose being to reduce to a minimum the reluctance of the magnetic closure 16. In order to guide it during movement, the cylindrical frame 14 has a ring-shaped sliding ridge 18 inside the reel of the coil 15, which projects slightly from the cylindrical surface of the frame 14, with the aim of not increasing the play between the coil 15 and the frame 14.

Through the construction of the electromagnetic actuator 3*a* described above the force necessary for operating the electromagnet 13,14,15 is always guaranteed, with the attraction of the frame 14 enabling a lifting stroke "R" of the seal member 9 greater than 2.5 mm, preferably 3 mm. When the valve hole 12 is, for example 6 mm, this minimum stroke "R" value contributes to the creation of a passage opening "A" in the valve 9,10 and of a sufficient area to enable a maximum flow "Q" to be transmitted from the inlet pipe 4.

The diameter "Da" of the moving frame for reducing the size of the electromagnet 13-16 and enabling it to be built into the pipe of the tap 2*a* is smaller than two times the length of the gap "G" necessary for the lifting stroke R greater than 2.5 mm of the seal 9.

A sizeable lifting "R" of the seal member 9, greater than 2.5 mm, is thus achieved, and at the same time a low reluctance of the electromagnet 13-16 to ensure it is operational during a long period of time, thereby generating the necessary electromagnet force to compensate for the wear and the resistance of the "sticking" of the seal member 9 against the valve seating 10, and the increase in the reluctance of the electromagnet due to the wear of the magnetic contact surfaces 13*a*, 14*a* caused by the impacts of the frame 14.

What is claimed is:

1. A gas tap having a built-in electromagnetic safety valve for the regulation of a gas flow to a domestic cooking appliance or a stove, the gas tap having a tap body and a regulation member located within the tap body for regulating the gas flow through the tap, the safety valve located within a housing of an elongate gas pipe formed unitarily with and as a part of the tap body, the safety valve situated downstream the regulation member within the tap body, the housing having an inlet opening to permit gas flow through the housing to a gas outlet located in the elongate gas pipe, the safety valve having an elongate electromagnetic actuator coupled to a seal member that is urged by a spring to rest against a seat within the tap body to occlude flow through the inlet opening, the actuator located within the gas flow path of the elongate gas pipe and comprising a coil positioned within an elongate magnetic steel capsule and powered by a DC voltage, an elongate magnetic frame located and moveable within the elongate magnetic steel capsule that has a first surface, and a stationary magnetic core having a base comprising a segment located within the elongate magnetic steel capsule with a second surface opposing the first surface of the magnetic frame, the ratio of the length of the electromagnetic actuator with the distance between the first and second surfaces is between 6.6 and 13.2 when the seal member rests against the seat, the actuator configured to move the seal member off the seat to permit a maximum gas flow through the gas tap when a supply current passes through the coil, each of the elongate magnetic steel capsule, coil, elongate magnetic frame, seal member and seat having a central axis substantially in common with a central axis of the elongate gas pipe and each being located entirely within the elongate gas pipe.

2. A gas tap according to claim 1 wherein the first and second surfaces are shaped to minimize the reluctance of a magnetic circuit of the electromagnetic actuator.

3. A gas tap according to claim 1 wherein the first and second surfaces are non-flat.

4. A gas tap according to claim 3 wherein the first and second non-flat surfaces have a substantially conical configuration.

5. A gas tap according to claim 1 wherein the ratio of the length of the electromagnetic actuator with the distance between the first and second surfaces is between 11.0 and 13.2.

6. A gas tap according to claim 1 wherein the elongate magnetic steel capsule forms a part of a magnetic circuit of the electromagnetic actuator.

7. A gas tap according to claim 6 wherein the external diameter of the magnetic capsule is less than 14 millimeters and the length of the electromagnetic actuator is less than 33 millimeters.

8. A gas tap according to claim 7 wherein the distance between the first and second surfaces is between 2.5 and 5.0 millimeters.

9. A gas tap according to claim 1 wherein the external diameter of the magnetic frame is less than two times the distance between the first and second surfaces.

10. A gas tap according to claim 8 wherein the external diameter of the magnetic frame is less than two times the distance between the first and second surfaces.

11. A gas tap according to claim 8 wherein the safety valve is configured to produce a lifting stroke of the seal member of greater than 2.5 millimeters.

12. A gas tap according to claim 6 wherein the base of the stationary magnetic core has a portion for engaging a first end of the magnetic capsule to close the magnetic circuit of the electromagnetic actuator, the base also having a peripheral ring-shaped surface for the airtight closure of the electromagnetic actuator against an inner wall surface of the pipe.

13. A gas tap according to claim 12 wherein the magnetic capsule is closed on a second end near the seal member by a collar.

14. A gas tap according to claim 6 wherein the magnetic frame has a cylindrical outer surface, the magnetic frame having a ring-shaped ridge that projects from the cylindrical outer surface and that slides along an inner surface of the magnetic capsule.

15. A gas tap according to claim 1 wherein the operating DC voltage is around 65/80 Vdc.

16. A gas tap according to claim 1 wherein each of the gas outlet, elongate magnetic steel capsule, coil, elongate magnetic frame, seal member and seat having a central axis substantially in common with a central axis of the elongate gas pipe.

17. A gas tap according to claim 1 wherein the regulation member of the gas tap has an inlet in flow communication with the inlet opening and an outlet in flow communication with an inlet of the safety valve, the seal member and seat of the safety valve being situated at the inlet of the safety valve in proximity to the outlet of the regulation member.

* * * * *